United States Patent [19]

Hart

[11] 4,415,078

[45] Nov. 15, 1983

[54] DISPLAY CARTON

[75] Inventor: Joseph J. Hart, Philadelphia, Pa.

[73] Assignee: Container Corporation of America, Chicago, Ill.

[21] Appl. No.: 361,750

[22] Filed: Mar. 25, 1982

[51] Int. Cl.[3] ..... B65D 5/50

[52] U.S. Cl. ..... 206/45.14; 206/45.34; 229/16 D

[58] Field of Search ..... 206/45.13, 45.34, 418, 206/45.19, 277, 528, 491, 492, 521; 229/16 D

[56] References Cited

U.S. PATENT DOCUMENTS

| | | | |
|---|---|---|---|
| 3,182,885 | 5/1965 | Maio | 206/418 |
| 3,361,330 | 1/1968 | Arneson | 206/418 |
| 3,388,787 | 6/1968 | Growney | 206/45.14 |
| 3,400,879 | 9/1968 | O'Brien et al. | 206/418 |
| 3,820,707 | 6/1974 | Fischer et al. | 206/418 |
| 3,949,868 | 4/1976 | Allen | 206/45.34 |
| 4,117,924 | 10/1974 | Growney | 206/45.14 |
| 4,260,059 | 4/1981 | Roccaforte | 206/418 |

*Primary Examiner*—Joseph Man-Fu Moy

*Attorney, Agent, or Firm*—Richard W. Carpenter; Davis Chin

[57] ABSTRACT

A shadow-box type display carton formed from a unitary blank of foldable paperboard.

8 Claims, 3 Drawing Figures

DISPLAY CARTON

BACKGROUND OF THE INVENTION

1. Field of the Invention

This invention relates generally to folding cartons and more particularly to a display carton of the type known as a shadow box, which has an opening in the front wall of the carton for displaying the packaged article.

2. Description of the Prior Art

The invention represents an improvement over the type of structure disclosed and claimed in U.S. Pat. No. Re. 28,530.

SUMMARY OF THE INVENTION

This invention relates generally to display cartons or shadow boxes formed of paperboard which are used to package and display articles of merchandise such as bottles, tubes, cans, or other items of similar shapes.

It is a purpose of the invention to provide, in a carton of the type described, a structure including an outer tubular carton and an inner tubular sleeve, which provides, a display area for advertising and which also forms, with portion of the outer carton, a channel for receiving and displaying a packaged article.

A more specific object of the invention is the provision, in the carton of the type described, of a collapsible carton structure formed from a one-piece blank of foldable paperboard which may be readily formed on a machine.

These and other objects of the invention will be apparent from an examination of the following description and drawings.

It will be understood, that for purposes of clarity, certain elements may have been intentionally omitted from certain views where they are believed to be illustrated to better advantage in other views.

DESCRIPTION OF THE PREFERRED EMBODIMENT

Figure 3:
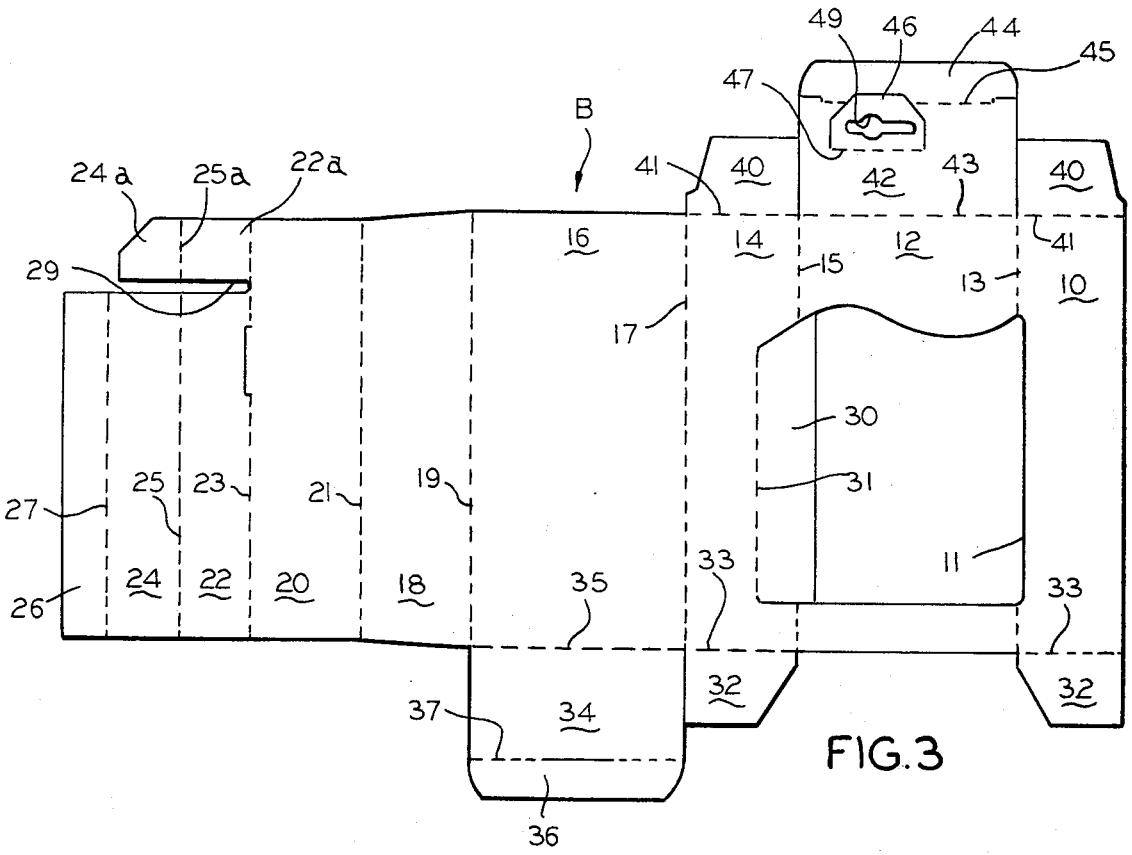
FIG. 3 is a plan view of a blank of foldable sheet material from which the carton illustrated in the other views may be formed.
Figure 1:
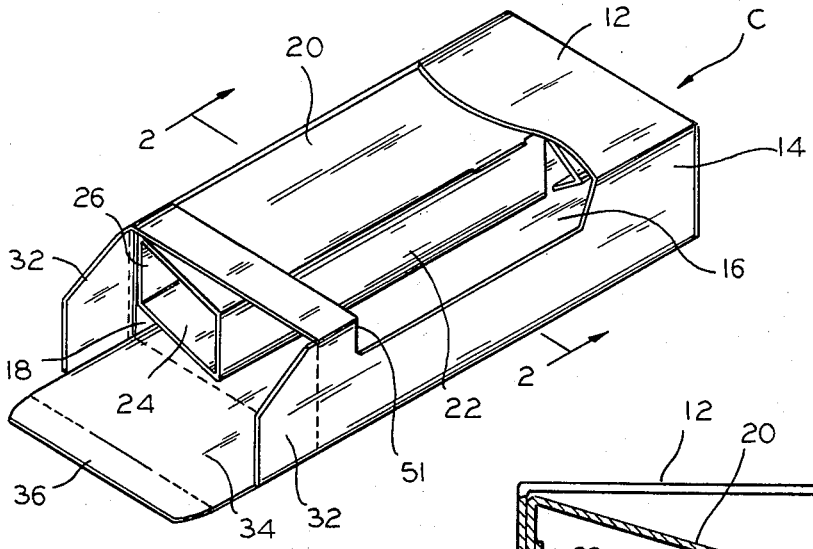
FIG. 1 is a perspective view of a display carton embodying features of the invention.
Figure 2:
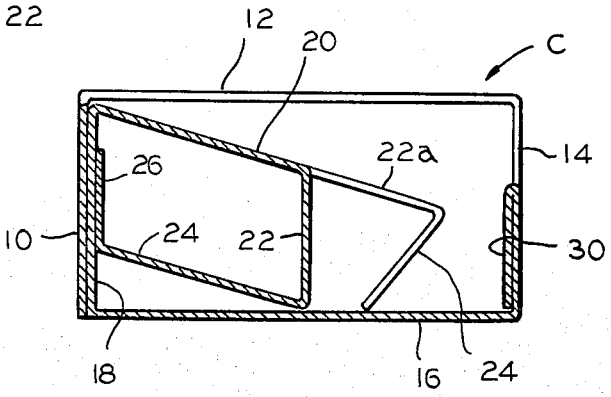
FIG. 2 is a transverse sectional view taken on line 2—2 of FIG. 1.

Referring now to the drawings for a better understanding of the invention, it will be seen that the display carton, indicated generally at C in FIGS. 1 and 2, may be formed from the unitary blank B of foldable sheet material, such as paperboard, illustrated in FIG. 3.

As best seen in FIG. 3, carton C includes a plurality of walls and panels foldably joined to each on parallel score lines. From right to left of FIG. 3 it will be seen that the carton includes: an outer first side wall panel 10, a front wall panel 12, a second side wall panel 14, a rear wall panel 16, an inner first side wall panel 18, a display or shadow panel 20, a central panel 22, a back panel 24, and a glue flap 26, all of which are foldably joined to each other along parallel fold lines 13, 15, 17, 19, 21, 23, 25, and 27, respectively.

It will be noted that panels 22 and 24 are divided into separate sections by a slot 29. Above the slot 29 are provided an extension **22*a* of panel 22 and an extension 24*a* of panel 24, which panel extensions are foldably joined to each other by a fold line 25*a*, which is an extension of fold line 25**.

As best seen in FIGS. 2 and 3, front wall panel 12 is provided with a cutout or window, indicated generally at 11, which permits the contents of the carton to be viewed from the outside. A portion of second side wall panel 14 is cut therefrom to form a reinforcing flap 30 which is foldably joined on fold line 31 to the remaining portion of panel 14. The purpose of this is to provide an enlargement of the opening 11 and also to reinforce the second side wall panel 14.

Closure of the lower end of the carton is accomplished by a pair of inner closure flaps 32, which are foldably joined on fold lines 33 to the lower edges of panels 10 and 14, and an outer closure flap 34 which is foldably joined on fold line 35 to the lower edge of rear wall panel 16. A tab flap 36 is foldably joined on fold line 37 to the outer edge of bottom closure flap 34.

A similar arrangement is provided for closure of the upper end of the carton. This closure arrangement includes inner closure flaps 40, which are foldably joined on fold on fold lines 41 to upper edges of panels 10 and 14, and upper closure flap 42, which is foldably joined on fold line 43 to the upper edge of panel 12, and a tuck tab 44 which is foldably joined on fold line 45 to the outer edge of upper closure flap 42.

In order to provide a means for suspending the carton from a hook for display there may be provided a hanger tab 46 cut from material of flap 42 and foldably joined to panel 42 on a fold line 47. Hanger tab 46 may be provided with an aperture 49 for attachment of the tab to a hook or other object.

As best seen in FIG. 2, the carton includes an outer tubular structure which consists of the front and rear major side walls and the inner minor side walls which are all foldably joined to each other, with the first side wall including a pair of outer and inner panels 10 and 18 secured to each other in overlapped relation.

The carton also includes an inner tubular structure or sleeve comprising panels 18, 20, 22, 24, and 26 which are also foldably joined to each other on parallel fold lines, with panel 26 being parallel to panel 22 and to first side wall inner panel 18, to which it is secured. As can best be seen in FIG. 2, the inner tubular structure forms a closed figure. Further, the cross-sectional shape of the inner tubular structure is preferably in the form of a rhomboid.

Thus, there is provided by the invention a completely collapsible structure of both the inner and outer sleeves, with the inner sleeve serving as a means of displaying and positioning the packaged article. The inner sleeve contains the display panel 20, which provides an area for advertising material and the central wall 22 is spaced from the second side wall panel 14 to provide, with the side wall panel and a portion of the bottom wall 16, a trough or channel for receiving and displaying the packaged article.

Panel extensions **22*a* and 24*a* of a finger-like shape project outwardly beyond the tubular structure to which it is formed integrally. These finger-like extesions serve to limit the lengthwise movement of the packaged article so as to position it in the portion of the tube which is exposed by the opening 11**.

A primary advantage of the present carton over those of the prior art is that all of the panels of both the outer and the inner tubular structures are folded in the same direction. Because of this, and the fact that no reverse folding is required, the structure may be formed more rapidly and less expensively on package-forming equipment.

Thus, it will be appreciated that the invention provides a unique display carton of relatively simple design and construction which provides a strong and secure means of packaging an article and also permitting the article to be viewed without opening the package itself.

What is claimed is:

1. A collapsible, display carton, for holding an article such as a tube, bottle, or can, said carton being formed of a unitary blank of foldable paperboard and comprising:

(a) pairs of opposed front and rear major side walls and first and second minor side walls foldably joined to each other to form an external tubular structure open at the ends;

(b) flap means for closing opposite ends of said structure;

(c) said front major side wall presenting, intermediate the ends of thereof, an opening for viewing the interior of said carton;

(d) an internal tubular structure positioned within said external tubular structure and secured to said first minor side wall;

(e) said internal tubular structure being spaced from said second minor side wall to define therewith and with said bottom wall a channel for receiving a packaged article;

(f) a major portion of said internal tubular structure being disposed under said front major side wall opening and including:

(i) a display panel foldably joined at it outer edge to a front portion of said first minor side wall and sloping toward said second minor side wall and said rear major side wall;

(ii) a central panel foldably joined at its front edge to the inner edge of said display panel and extending rearwardly toward said rear major side wall and in spaced parallel relation with said second minor side wall;

(iii) a back panel foldably joined at its inner edge to the rear edge of said central panel and sloping toward said first minor side wall panel and said front major side wall panel in spaced parallel relation with said display panel;

(iv) a glue flap foldably joined at its rear edge to the inner edge of said back panel and being secured to the inner side of said first minor side wall panel.

2. A carton according to claim 1, wherein each of the panels of the carton is folded in the same direction from the panel to which it is attached.

3. A carton according to claim 1, wherein said first minor side wall includes a pair of inner and outer panels secured to each other in overlapped relation.

4. A carton according to claim 1, wherein the flap means for closing one end of the external tubular structure includes a hanger tab cut from material of and foldably joined to a closure flap.

5. A carton according to claim 1, wherein the cross section of said internal tubular structure is a closed figure.

6. A carton according to claim 1, wherein said internal structure has a cross section in the form of a rhomboid.

7. A carton according to claim 1, and including means for limiting the movement of a packaged article lengthwise of the carton.

8. A carton according to claim 7, wherein said means includes at least one finger-like extension integral with and projecting from said internal structure.

* * * * *